United States Patent [19]

Sekiya et al.

[11] Patent Number: 4,990,939

[45] Date of Patent: Feb. 5, 1991

[54] BUBBLE JET PRINTER HEAD WITH IMPROVED OPERATIONAL SPEED

[75] Inventors: Takuro Sekiya, Yokohama; Kyuhachiro Iwasaki, Fujisawa; Takashi Kimura; Tomoaki Nakano, both of Yokohama, all of Japan

[73] Assignee: Ricoh Company, Ltd., Tokyo, Japan

[21] Appl. No.: 398,237

[22] Filed: Aug. 24, 1989

[30] Foreign Application Priority Data

| | | | |
|---|---|---|---|
| Sep. 1, 1988 | [JP] | Japan | 63-218889 |
| Dec. 8, 1988 | [JP] | Japan | 63-310904 |
| Aug. 9, 1989 | [JP] | Japan | 1-207529 |

[51] Int. Cl.[5] ..... B41J 2/05

[52] U.S. Cl. ..... 346/140 R

[58] Field of Search ..... 346/140

[56] References Cited

U.S. PATENT DOCUMENTS

| | | | |
|---|---|---|---|
| 4,392,907 | 7/1983 | Shirato | 346/140 X |
| 4,458,256 | 7/1984 | Shirato | 346/140 R |
| 4,663,640 | 5/1987 | Ikeda | 346/140 |
| 4,686,544 | 8/1987 | Ikeda | 346/140 |

*Primary Examiner*—Joseph W. Hartary

*Attorney, Agent, or Firm*—Cooper & Dunham

[57] ABSTRACT

A bubble jet printer head comprises a base plate, an ink chamber provided on the phase plate, a device for supplying ink to the ink chamber, an ink passage provided on the base plate from the ink chamber to an orifice at a front end, and a heating element at the ink passage for heating the ink to form a bubble. The heating element includes a first electrode strip extending on the base plate to the ink chamber along the ink passage, an electrical insulator layer covering the first electrode strip except for the front and rear ends thereof, the electrical insulator layer having a front end facing the orifice, a resistance strip provided on the electrical insulator layer and having a front end in contact with the front end of the first electrode strip and extending rearwardly along and over the electrical insulator layer, and a second electrode strip provided on the electrical insulator layer in contact with the rear end of the resistance strip and extending rearwardly to the ink chamber along and over the electrical insulator layer.

11 Claims, 5 Drawing Sheets

FIG. 3 (PRIOR ART)
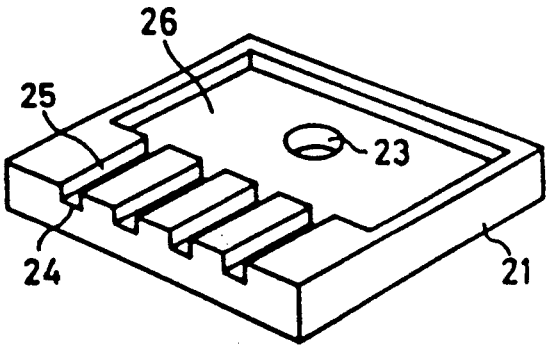
FIG. 4A
FIG. 4B
FIG. 4C
FIG. 4D
FIG. 4E
FIG. 4F
FIG. 4G
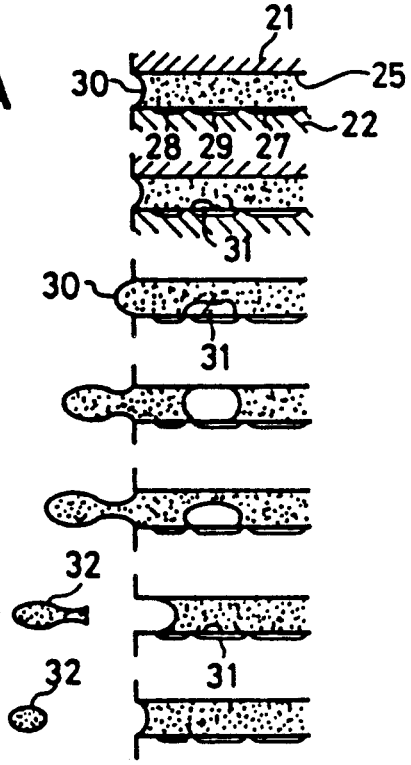

FIG. 5
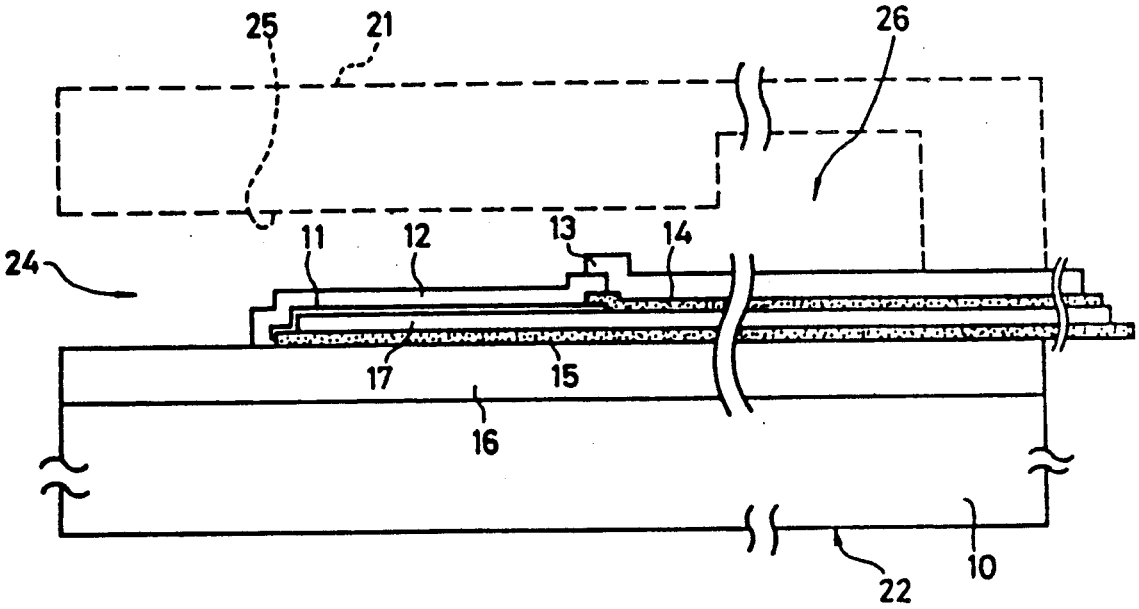
FIG.6A FIG.6C FIG.6E
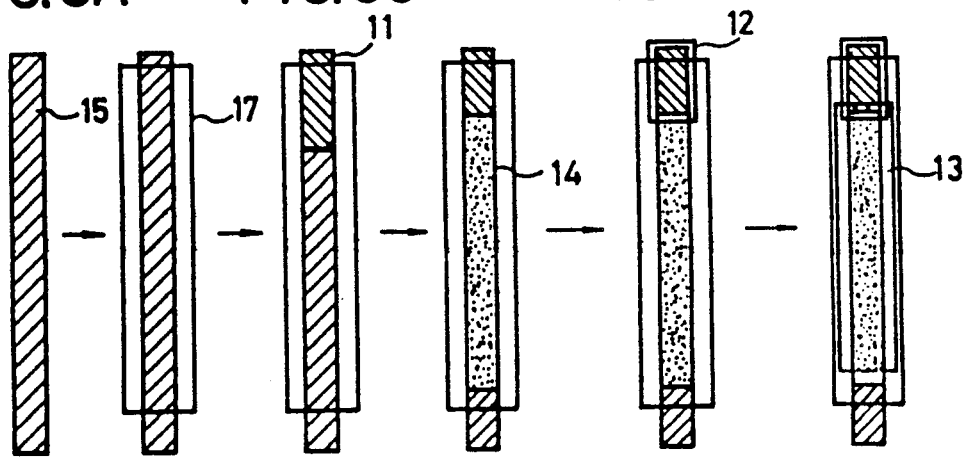
FIG.6B FIG.6D FIG.6F

50°C Isotherm

150°C Isotherm

BUBBLE JET PRINTER HEAD WITH IMPROVED OPERATIONAL SPEED

BACKGROUND OF THE INVENTION

The present invention generally relates to thermal ink jet printers and in particular to a recording head of such a printer for projecting droplet of ink by a force of bubble created in the ink.

Non-impact recording is substantailly free from noise and is widely used in personal computers and various information processing apparatuses. Particularly, a so-called ink jet printer is used extensively because of its high speed and ease of use as this type of printer does not require specially processed paper or fixing procedure after the printing.

There are wide variety of approaches to realize the ink jet printer for actual use, some already established, some still under development.

Generally, an ink jet printer projects a droplet of recording liquid called ink so that the droplet is deposited on a recording medium such as a paper. There are several known methods to form such a droplet and to control the movement of the droplets thus formed.

In a first typical prior art method known as "TELETYPE" system disclosed in the U.S. Pat. No. 3,060,429, the droplet of ink is formed electrostatically and the movement or trajectory of the droplet thus formed is controlled by an electrical field which is changed in correspondence to a recording signal. More specifically, an electrical field is applied between a nozzle for ejecting the ink droplet and an acceleration electrode disposed in front of the nozzle. The nozzle ejects an ink droplet which is charged uniformly and the droplet thus ejected is passed through an X-deflection electrode and a Y-deflection electrode both producing a control electrical field responsive to the recording signal. Thus, the droplet is projected along a trajectory which is determined by the recording signal and arrives at a desired point on the paper.

In a second typical prior art method known as "SWEET" method disclosed in the U.S. Pat. No. 3,596,275, the droplet of ink is formed by a continuous ultrasonic vibration such that the formed droplet has a controlled electrical charge. More specifically, a piezoelectric oscillator or transducer is provided on a printer head for forming the droplet and an electrode applied with a recording signal is provided in front of an orifice of nozzle with a predetermined separation. In operation, the piezoelectric transducer is driven by an electrical signal having a predetermined frequency, and responsive thereto, the droplet of ink is formed by atomization. This droplet is ejected from the nozzle and passes through the electrode whereby the droplet is provided with an electrical charge in correspondence to the recording signal applied to the electrode. The droplets thus charged are deflected according to the amount of the electrical charge they are carrying when they pass by a deflection electrode.

In a third typical prior art method known as "HERTZ" system disclosed in the U.S. Pat. No. 3,416,153, an electrical field is established between a nozzle and a ring-shaped charging electrode, whereby atomization of ink droplet is controlled by modulating the electrical field responsive to a recording signal. According to this method, printing with gradation of recording image can be achieved.

In a fourth typical prior art method known as "STEMME" system disclosed in the U.S. Pat. No. 3,747,120, droplet of ink is ejected from a nozzle under control of a recording signal. Thus, this method is fundamentally different from those three other prior art methods in which the trajectory of the droplet is controlled electrostatically to achieve a desired printing. More specifically, the Stemme system uses a piezoelectric transducer for atomizing the ink by a mechanical vibration which in turn is caused by the recording signal.

In each of these four prior art methods, there are still various problems. For example, the first and third prior art methods need a high voltage to create the droplet, and associated therewith, there is a problem in that assembling of a number of recording nozzles in a single recording head becomes difficult. When the number of nozzle in the printer head is reduced, the speed of printing is reduced. The second prior art method, though allowing a multi-nozzle construction relatively easily, has a problem in that the construction of the recording head is complex and needs a delicate electrical control in order to achieve a desired printing result. Further, the second method has a problem in that so-called satellite dot tends to appear on the recording paper. In the third method, though capable of recording an image with excellent gradation, has a problem in that the control of atomization is difficult, the printed image tends to suffer from fog, and that the multi-nozzle construction is difficult which in turn means that the method is not suited for high speed printing.

The fourth method has various advantages over the first through third prior art methods in that the recording head has a simple construction, recovery of those droplets not used for recording can be eliminated in contrast to the first through third prior art methods, as the ink droplet is created on-demand responsive to the recording signal, and that the use of electrically conductive ink can be eliminated in contrast to the first and second prior art methods. Thereby, a wide variety of inks can be used.

This last prior art method, however, also has a problem in that the machinning of the recording head is difficult and that the miniaturization of the piezoelectric transducer having a desired resonant frequency is extremely difficult. This difficulty in turn invites difficulty in achieving multi-nozzle construction for the recording head and the printing speed of the head is inevitably reduced. Further, this method is disadvantageous for high speed printing as the droplet is created by mechanical vibration of the piezoelectric transducer.

The aforementioned U.S. Pat. No. 3,747,120 also describes a modification of the fourth prior art method in which thermal energy instead of mechanical vibrational energy is used for creating the droplet. According to the description therein, a heating coil is used for directly heating the ink to form a high pressure vapor which in turn causes pressure increase in the ink. Thus, the printer disclosed operates as a so-called bubble jet printer.

However, the aforementioned U.S. patent, while disclosing vaporization of ink in an ink chamber having a single outlet by direct heating of the ink using a heating coil supplied with current and acting as pressurizing means, is entirely silent about how to heat the ink when the ejection of ink is to be performed repeatedly. Further, the heating coil is provided at an innermost section of the ink chamber away from the outlet and thus there is a problem of complex head construction inadequate for high speed printing operation. Further, this prior art reference is silent about how to prepare for next ink jet ejection after an ink jet is ejected by the action of heat. Note that this is extremely important for actual use.

Thus, the prior art methods reviewed heretofore are unsatisfactory from the view point of high speed printing, multi-nozzle construction, appearance of satellite dots, fog in the printed image and the like, and they could only be used for limited applications where the problem inherent thereto does not cause serious difficulty.

On the other hand, the Laid-open Japanese Patent Application No. 82663/1980 describes a bubble jet printer having an improved response of ink droplet ejection and an improved temperature response of heater used therein for creating an ink vapor, wherein a part of the ink from which the vapor is to be formed is rapidly cooled by cooling a substrate holding the heater such that the temperature of the heater is rapidly cooled after ejection. According to this prior art printer, formation of bubbles due to dissolved oxygen and the like in the ink after ink droplet ejection is minimized and the speed of printing is improved. Further, the Laid-open Japanese Patent Application No. 211045/1986 discloses a bubble jet printer wherein heater and temperature detection means are provided on a printer head unit and the printer head unit is air cooled by a blower. The printer further has a controller for driving the heater and to energize the blower responsive to a signal from the temperature detection means, and as a result, the printer can maintain the temperature of the printer head unit at a temperature suitable for forming the ink droplet. However, these prior art bubble jet printers are not designed for effective heat dissipation and have to rely upon external cooling means such as large and bulky heat sink or blower provided separately from the printer head. Such a construction occupies a large space and is obviously disadvantageous for a high speed printer where a number of nozzles are provided on the printer head unit.

Meanwhile, a bubble jet printer disclosed in the Japanese Laid-open Patent Application No. 128468/1980 describes a protection layer of heater used in the printer which is chosen singularly or in combination from: a group of transitional metal oxides such as titanium oxide, vanadium oxide, niobium oxide, molybdenum oxide, tantalum oxide, tungsten oxide, chromium oxide, zirconium oxide, hafnium oxide, lanthanum oxide, yttrium oxide, manganese oxide and the like; a group of metal oxides such as aluminium oxide, calcium oxide, strontium oxide, barium oxide, silicon oxide and the like; a group of nitrides having a high resistivity such as silicon nitride, aluminium nitride, boron nitride, tantalum nitride and the like; or a group of semiconductor materials which, although having a low resistivity as a bulk, exhibits a high resistivity when formed in a thin film having a thickness of 0.1 μm–5 μm, preferrably 0.2 μm–3 μm by sputtering, chemical vapor deposition, vacuum deposition, vapor-phase reaction, liquid coating and the like such as amorphous silicon and amorphous selenium. Note that such a protective film is essential for avoiding corrosion of the heater by reaction with the ink and to avoid short circuit conduction across the ink.

Alternatively, there is proposed to cover the heater by a resin which is easily formed into film, and when formed into a film, forming a dense structure which is substantailly free from pinholes, free from swelling or dissolution even when contacted with ink, having a high resistivity when formed into film and having an excellent resistance to heat. Such material may be chosen from silicone, fluorocarbon resin, aromatic polyamides, polyimide addition polymers, polybenzimidazole, metal chelate polymers, titanate esters, epoxy resin, phtalic acid resin, thermosetting phenol resin, polyvinylphenol resin, Zirox resin, triazine resin, BT resin comprising an addition polymerized resin of triazine resin and bismaleimide, and the like. Further, the film may be formed by deposition of polyxylilene resin and its derivatives.

Alternatively, the protection film may be formed by plasma polymerization of various organic monomers such as thiourea, thioacetoamide, vinylferrocene, 1,3,5-trichlorobenzene, chlorobenzene, styrene, ferrocene, picoline, naphthalene, pentamethylbenzene, nitrotoluene, acrylonitrile, diphenylselenide, P-toluidine, P-xylene, N-dimethyl-P-toluidine, toluene, aniline, diphenylmercury, hexamethylbenzene, malononitrile, tetracianoethylene, thiophene, benzeneselenole, tetrafluoroethylene, ethylene, N-nitrosodiphenylamine, acethylene, 1,2,4-trichlorobenzene, propane and the like.

However, these materials are still unsatisfactory for use in the bubble jet printer for protecting the heater from the view point of high resistance to corrosion and good thermal conductivity. Note that good thermal conductivity is essential for the protective film of heater in order to achieve a quick response of the printer head.

SUMMARY OF THE INVENTION

Accordingly, it is a general object of the present invention to provide a novel and useful bubble jet printer wherein the problems aforementioned are eliminated.

Another and more specific object of the present invention is to provide a thermal ink jet printer having an improved response and capable of printing at a high speed.

Another object of the present invention is to provide a bubble jet printer head suitable for a multi-nozzle construction and capable of printing with a high recording density.

Another object of the present invention is to provide a bubble jet printer head having a structure for facilitating heat dissipation.

Another object of the present invention is to provide a bubble jet printer head for ejecting an ink droplet by a dilatational force of bubble which is formed by a heater heating the ink, wherein a heat accumulation layer of a thermally insulating material is provided adjacent to the heater in combination with a substrate having a large thermal conductivity such that an isotherm formed adjacent to the heater immediately after ejection of an ink droplet extends towards an ink chamber. According to the present invention, the heat remaining after the formation of bubble is immediately dissipated and the response of the printer is improved.

Another object of the present invention is to provide a bubble jet printer wherein a heater for heating an ink to form a jet of ink droplet is protected by a layer of carbon having a diamond-like structure. According to the present invention, a fast response can be achieved as such a diamond-like carbon layer has an excellent thermal conductivity Further, the printer operates stably as the heater is protected against corrosion by the layer of diamond-like carbon which is stable when contacted with the ink.

Other objects and further features of the present invention will become apparent from the following detailed description when read in conjunction with attached drawings

BRIEF DESCRIPTION OF THE DRAWINGS

FIG. 3 is a view showing a bottom side of a cover lid of FIG. 2;

FIGS. 4(A)–(G) are diagrams explaining various steps of ink droplet ejection by the force of bubble in the printer head of FIG. 1;

FIG. 5 is a side view of the printer head according to an embodiment of the present invention;

FIGS. 6(A)–(F) are diagrams showing various steps of forming a part of the structure shown in FIG. 5;

DETAILED DESCRIPTION

Figure 1:
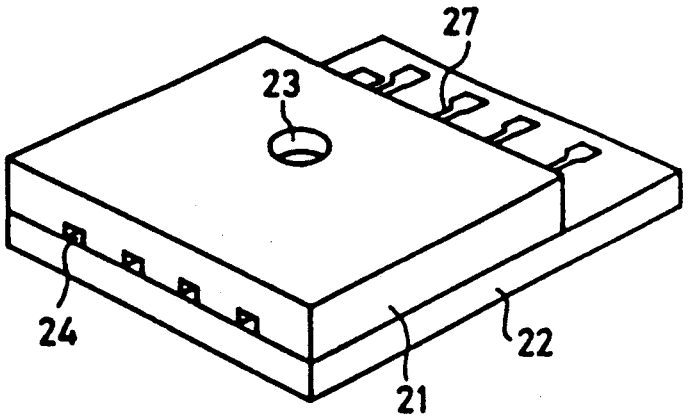
FIG. 1 (PRIOR ART)
FIG. 1 is a perspective view showing a prior art printer head used in a bubble jet printer.

First, a general construction of the bubble jet printer will be described with reference to FIG. 1 showing a prior art printer head in perspective view.

Figure 2:
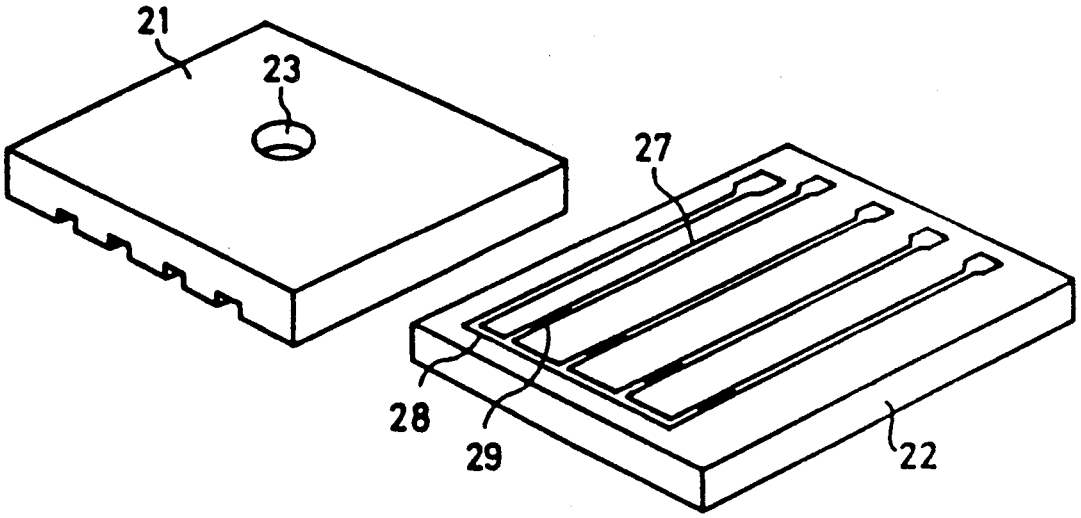
FIG. 2 (PRIOR ART)
FIG. 2 is an exploded view of the printer head of FIG. 1.

Referring to FIG. 1, the printer head comprises a base plate 22 carrying a heater connected to an electrode 27 and a cover lid 21 disposed above the base plate 22. As will be described later with reference to the present invention, the base plate 22 used in the present invention may comprise silicon having a surface deposited by silicon oxide. Alternatively, the base plate 22 may be a so-called glazed alumina commonly used for other type of thermal heads. The cover lid 21 is defined with an ink inlet 23 for receiving ink and an outlet orifice 24 for ejecting an ink droplet as a jet. As can be seen from an exploded view of FIG. 2, the base plate 22 carries a conductor pattern 27 acting as a first electrode and another conductor pattern 28 acting as a second electrode, and a heater 29 is formed between the first and second electrodes.

FIG. 3 shows a bottom view of the cover lid 21. As can be seed in the drawing, the cover lid 21 is defined with an ink chamber 26 in communication with the ink inlet 26 and an ink passage 25 is grooved so as to pass the ink in the ink chamber 26 to the outlet orifice 24. When assembled, the ink passage 25 registers with the heater 29 and the ink in the passage 25 is heated by the heater 29.

Next, the operation of the bubble jet printer will be described with reference to FIGS. 4(A)–(G) showing various stages of ink droplet formation and projection.

In a first step shown in FIG. 4(A), an ink 30 in the passage 25 defined between the cover lid 21 and the base plate 22 is stationary and there is established an equilibrium between the ink 30 having a predetermined surface tension and the external pressure acting to the ink. Note that the heater 29 connected across the electrodes 27 and 28 is in contact with the ink 30 in the passage 25. In a step of FIG. 4(B), the heater 29 is energized and there appears a boiling in the ink 30 immediately adjacent to the heater 29 as a result of steep temperature rise at the surface of the heater 29. Thus, there appear minute bubbles 31 scattered along the heater 29. With further heating in a step of FIG. 4(C), the minute bubbles are assembled to form a large single bubble 31. Responsive to the growth of the bubble 31, the pressure of the ink 30 in the passage 25 is increased and the ink starts to project from the orifice 24. FIG. 4(D) shows a state wherein the bubble 31 is fully grown and the ink starts to form a droplet at the orifice 24, though it is not separated from the ink 30 in the passage 25. Shortly before the state of FIG. 4(D), the energization of the heater 29 is terminated and the temperature at the surface of the heater 29 is already descending. It should be noted that there is some delay between the moment in which the temperature of the heater 29 reaches maximum and the moment in which the volume of the bubble 31 becomes maximum. In a step of FIG. 4(E) the temperature of the ink 30 in the passage is still decreasing while the part of the ink 30 projected outside the orifice 24 is moving by the inertia. As a result of the continuous movement of the ink at the outside of the orifice 24 together with contraction of the ink 30 in the passage 25 due to temperature decrease, there appears a neck at a part connecting the part of ink at the outside of the orifice 24 and the ink remaining in the passage 25 which becomes rapidly thinner with time until the part of the ink outside of the orifice 24 is separated as an ink droplet 32 as shown in FIG. 4(F). Note that the bubble 31 is further contracted in FIG. 4(F) and there appears a meniscus invading into the passage 25 while the droplet 32 is moving with a speed of about 5–10 m/sec towards a recording paper (not shown). In a next step of FIG. 4(G), the bubble is completely vanished and the ink is refilled into the chamber 26 through the inlet 23 by the capillary action. Thereby, the equilibrium state similar to FIG. 4(A) is resumed except that the droplet 32 is continuing its movement.

As will be understood from the description heretofore, it is essential to heat the ink rapidly and then to dissipate the heat also rapidly in order to achieve a quick response or high operational speed of the printer. On the other hand, the heater as well as the electrode of the printer head are generally separated from the ink by a protective film so as to avoid undesirable corrosion as well as to avoid short circuit conduction across the ink.

Next a first embodiment of the present invention to increase the response of the printer head will be described with reference to FIG. 5. In the drawing, the parts constructed identically to those corresponding parts in the previous drawings are given identical reference numerals and the description thereof will be omitted.

Referring to FIG. 5, the base plate 22 comprises a substrate 10 covered by a heat accumulation layer 16 of a thermally insulating material and a first electrode 15 provided on the layer 16 so as to extend from the passage 25 to the ink chamber 26. Further, an insulator layer 17 is provided on the electrode 15 except for its both ends and a heater 11 is provided on the insulator layer 17 close to its front end at a side of the orifice 24 so as to contact with the exposed front end of the electrode 15. Further, a second electrode 14 is provided on the insulator layer 17. Note that the second electrode 14 extends also to the ink chamber 26. Furthermore, the heater 11 is covered by a heater protective layer 12 and the electrode 14 is covered by an electrode protective layer 13. As already described, the substrate 10 constituting the base plate 22 may be made of silicon in the present invention and in that case the heat accumulation layer 16 may be formed by thermal oxidization of silicon. Alternatively, the layer 16 may be formed by sputtering or chemical vapor deposition of silicon oxide. In another example, the substrate may comprise alumina covered by a graze acting as the heat accumulation layer 16.

Note that the heat accumulation layer 16 insulates the heater 11 thermally from the substrate 10 at the very beginning of energization of the heater 11 to heat the ink such that the heat generated to the heater is effectively transferred to the ink and not dissipated to the substrate immediately. However, the heat accumulation layer 16 has to be very thin, preferrably about 1 μm or less so as to allow quick and free heat dissipation into the substrate 10 after the energization of the heater 11 is terminated as will be described with reference to the response of the printer head.

Next, the procedure to construct the printer head, particularly a heater assembly including the heater 11 and the electrodes 14 and 15 will be described with reference to FIG. 6. The structure shown in FIG. 5 may be formed as follows. First, the electrode 15 is deposited on the heat accumulation layer 16 (FIG. 6(A)) and the electrode 15 is covered by the insulator layer 17 except for its both ends where electrical connection to the heater 11 to be deposited is made and where electrical connection to external lead wire is made (FIG. 6(B)). Various materials such as aluminium, silver, gold, platinum, copper and the like may be used for the electrodes 14 and 15 and these materials are vacuum deposited or sputtered at a predetermined position with a predetermined size, shape and thickness. As for the material for the insulating layer 17, commonly used materials such as silica, silicon nitride and the like may be used by depositing according to sputtering or chemical vapor deposition technique in combination with known photolithography and etching technique. The thickness of the insulating layer is preferably from about 0.1 μm to 10 μm.

Next, the heater 11 is deposited in connection with the first electrode 15 as shown in FIG. 6(C). The material constituting the heater 11 may be a mixture of tantalum and silica, tantalum nitride, Nichrome, silver palladium alloy, semiconductor silicon, or a boride of metals such as hafnium, lanthanum, zirconium, titanium, tantalum, tungsten, molybdenum, niobium, chromium, vanadium and the like, wherein metal borides are preferred. The most preferred is hafnium boride and subsequently zirconium boride, lanthanum boride, tantalum boride, vanadium boride, niobium boride are preferred in this order. The heater may be deposited by electron beam deposition or sputtering using these materials and the thickness of the heater as well as the shape and size are set such that a desired heat per unit time is obtained and a desired electrical power consumption is achieved. Normally, the thickness of the heater 11 is set to 0.001–5 μm, preferably from 0.01–1 μm.

Next, the second electrode 14 is deposited (FIG. 6(D)) and the heater protective layer 12 is deposited on the heater 12 as well as on the electrode 14 (FIG. 6(E)). In this case, the electrode 14 covers a part of the heater 11 as shown in FIG. 5. Alternatively, the electrode 14 may be deposited prior to the deposition of the heater 11. In this case, the end of the heater in contact with the electrode 14 is not buried under the electrode but the electrode 14 is buried under the heater 11.

The heater protective layer 12 is required to protect the heater from the ink without deteriorating effective heat transport from the heater to the ink. As a material for the protective layer 12, silicon oxide, silicon nitride, magnesium oxide, aluminium oxide, tantalum oxide, zirconium oxide, tantalum and the like are conventionally used. In the present invention, so-called diamond-like carbon to be described is preferred. The thickness of the protective film is usually set to 0.01–10 μm, preferably 0.1–5 μm, and most preferably 0.1–3 μm.

Finally, the electrode protective layer 13 for protecting the electrode 14 from the ink is deposited in a step of FIG. 6(F) and the structure of FIG. 5 is completed. As for the material of the protective layer 13, organic substances which facilitates fine photolithographic patterning is preferred particularly when the printer is the multi-orifice type for high density printing. Such a material include: polyimidoisoindoloqunazoline dione (trade name: PIQ, supplied by Hitachi Kasei Co, Japan); polyimide resin (trade name: Pyralin, supplied by Du Pont, U.S.A.); Cyclized polybutadiene (trade name: JSR-CBR, CBR-M 901, supplied by Japan Synthesis Rubber Co. Japan); Photonith (trade name; supplied by Toray Co., Japan), and other photosensitive polyimide resins.

In the printer head thus constructed, it is essential that the dissipation of heat produced by the heater 11 for ejecting the ink droplet is achieved efficiently. For this purpose, a substrate having a large thermal conductivity is used in combination with a thin heat accumulation layer having a small thermal conductivity. By suitably choosing the material for the substrate 10 and the heat accumulation layer 16, one can design a structure where the heat dissipates quickly to the ink chamber 26 rather to the orifice 24.

TABLE I compares heat dissipation for various combination of materials together with the maximum response frequency obtained. As is clear from TABLE I, the first combination of pyrex glass and silica, both having a substantially same thermal conductivity, provides inferior heat dissipation and accordingly a slow response. A same tendency holds also for the second combination of photoceram and silica where the ratio of thermal conductivity is about 3:1 between the substrate and the heat accumulation layer. In contrast, the third and fourth combinations of silicon and silica or alumina and silica where the thermal conductivity of the substrate is far more larger than that of the heat accumulation layer, provide an excellent heat dissipation towards the ink chamber and an excellent response. Note that the ratio of thermal conductivity between the substrate and the heat accumulation layer is about 80:1 for the third combination and about 20:1 for the fourth combination. Thus, it is discovered that the dissipation of heat from the printer head after ejection of the ink droplet is mainly controlled by the thermal conductivity of the substrate forming the base plate of the printer head. In addition to the thermal conductivity, large specific heat and high density of the substrate may also contribute to the effective heat dissipation.

Figure 7A:
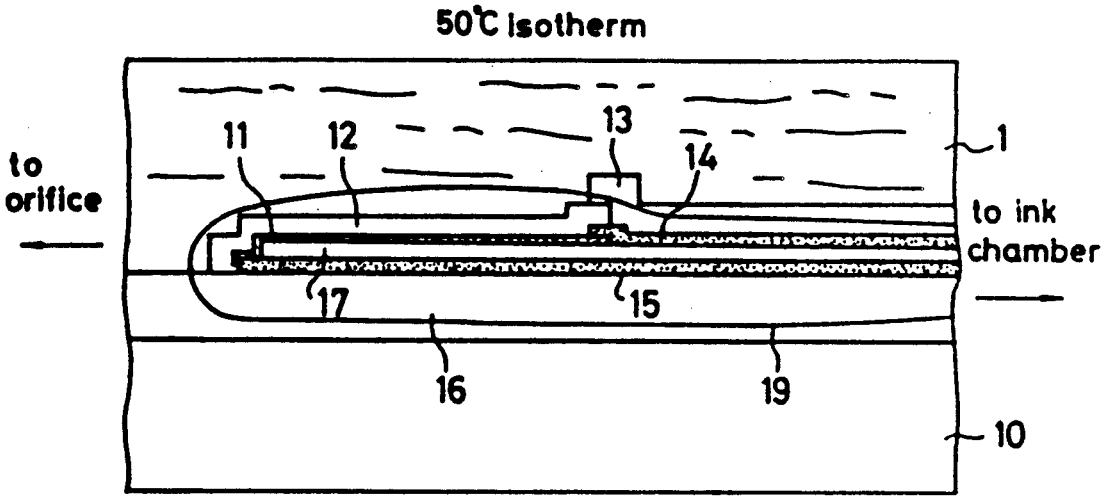
FIGS. 7(A) and (B) are diagrams showing an isotherm respectively at 50° C. and 150° C. for the printer head of the present invention.
Figure 7B:
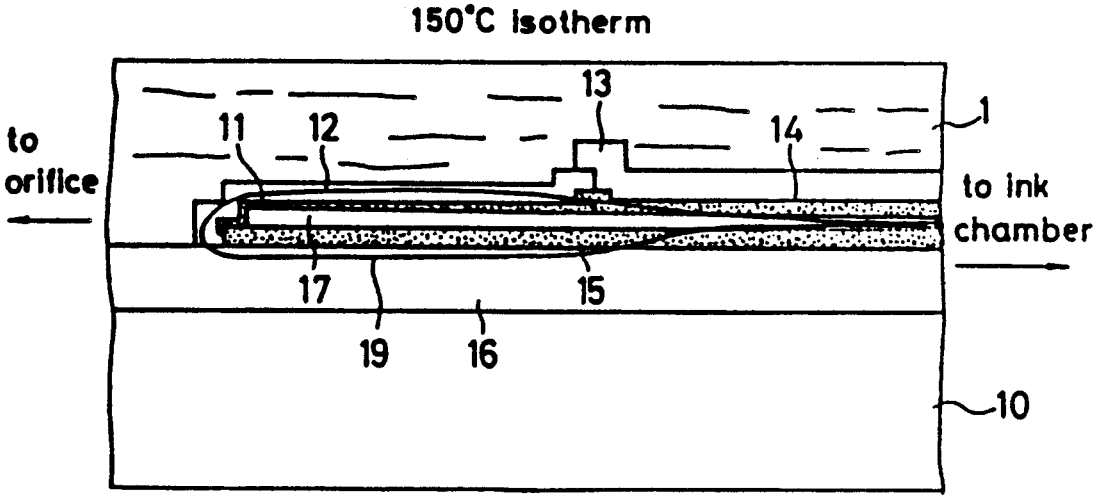

FIGS. 7(A) and (B) show an isotherm at 50° C. and 150° C. after a pulse-like heating for 5 μm for a printer head having a structure shown in FIG. 5. In this example, the ratio of the thermal conductivity between the substrate and the heat accumulation layer was set to about 70:1 and the printer head used for experiment had an orifice diameter of 20 μm. An water soluble ink (pH=9.8) was used. From these drawings, it can be seen that the heat generated by the heater 11 is rapidly dissipating towards the ink chamber 26. In the illustrated example, a maximum response frequency of 5.2 kHz was achieved.

Figure 8A:
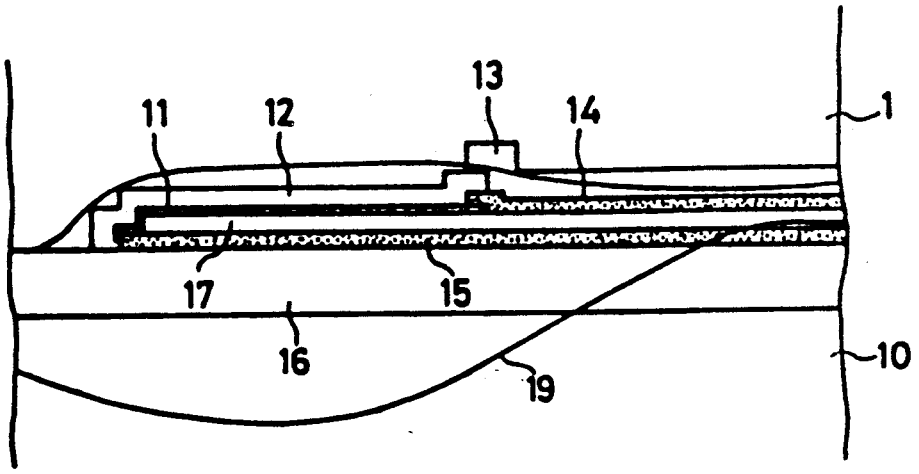
FIGS. 8(A) and (B) are diagrams showing the isotherm at 50° C. and 150° C. for a different setting for the purpose of comparison.
Figure 8B:
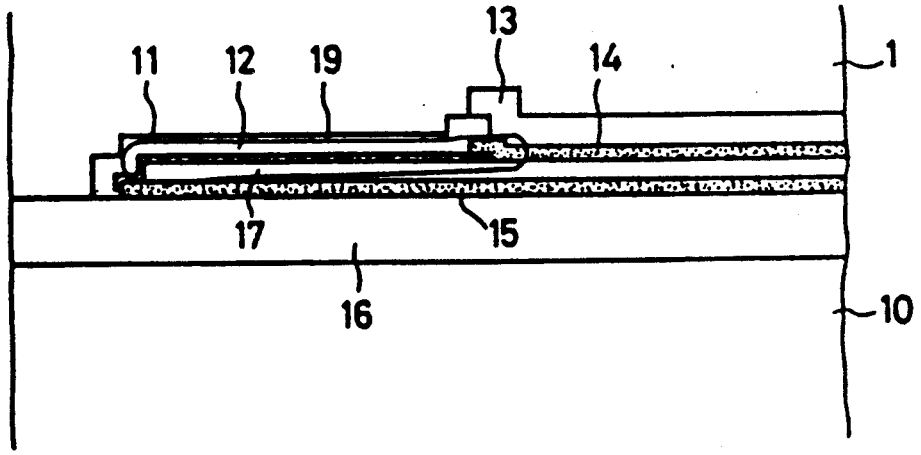

FIGS. 8(A) and (B) on the other hand show a case in which the ratio of the thermal conductivity between the substrate and the heat accumulation layer is about 3:1. In this case, it can be seen that the heat dwells about the heater even after deenergization of the heater or dissipates slowly to the orifice of the printer head. In this case, the maximum response frequency which could be achieved was only 0.6 kHz.

TABLE I

Heat dissipation performance and maximum response frequency of printer head

| | | |
|---|---|---|
| **CASE I** | | |
| substrate: | pyrex glass | t.c. 0.0109 J/cm.s.K<br>s.h. 0.78 J/g.K<br>d. 2.32 g/cm$^3$ |
| heat accumulation layer*: | $SiO_2$ | t.c. 0.0109 J/cm.s.K.<br>s.h. 0.737 J/g.K.<br>d. 2.2 g/cm$^3$ |
| 50° C. isotherm: | | |
| heat flow direction: | orifice and chamber | |
| dwell of heat: | yes | |
| 150° C. isotherm: | | |
| heat flow direction: | uncertain | |
| dwell of heat: | yes | |
| Maximum response frequency: | 0.8 kHz | |
| **CASE II** | | |
| substrate: | photoceram | t.c. 0.255 J/cm.s.K<br>s.h. 0.878 J/gK<br>d. 2.407 g/cm$^3$ |
| heat accumulation layer*: | $SiO_2$ | t.c. 0.0109 J/cm.s.K.<br>s.h. 0.737 J/g.K<br>d. 2.2 g/cm$^3$ |
| 50° C. isotherm: | | |
| heat flow direction: | orifice | |
| dwell of heat: | yes | |
| 150° C. isotherm | | |
| heat flow direction: | orifice | |
| dwell of heat: | yes | |
| Maximum response frequency: | 0.7 kHz | |
| **CASE III** | | |
| substrate: | silicon | t.c. 0.84 J/cm.s.K<br>s.h. 0.761 J/g.K<br>d. 2.34 g/cm$^3$ |
| heat accumulation layer*: | $SiO_2$ | t.c. 0.0109 J/cm.s.K<br>s.h. 0.737 J/g.K<br>d. 2.2 g/cm$^3$ |
| 50° C. isotherm: | | |
| heat flow direction: | ink chamber | |
| dwell of heat: | no | |
| 150° C. isotherm: | | |
| heat flow direction: | ink chamber | |
| dwell of heat: | no | |
| Maximum response frequency: | 4.9 kHz | |
| **CASE IV** | | |
| substrate: | alumina | t.c. 0.293 J/cm.s.K<br>s.h. 1.0465 J.g.K.<br>d. 3.93 g/cm$^3$ |
| heat accumulation layer*: | $SiO_2$ | t.c. 0.0109 J/cm.s.K<br>s.h. 0.737 J/g.K<br>d. 2.2 g/cm$^3$ |
| 50° C. isotherm: | | |
| heat flow direction: | ink chamber | |
| dwell of heat: | no | |
| 150° C. isotherm: | | |
| heat flow direction: | ink chamber | |
| dwell of heat: | no | |
| Maximum response frequency: | 4.8 kHz | |

t.c.: thermal conductivity
s.h.: specific heat
d.: density, *thickness 1 μm

Thus, the printer head of the present invention, using silicon or alumina for the substrate of the base plate in combination with silica heat accumulation layer, provides an excellent response suitable for a high speed printer.

In the present invention, the protective layer 12 comprises a so-called i-carbon or amorphous carbon which is a carbon thin film having a structure similar to diamond. Such a carbon thin film has an atomic arrangement similar to diamond with respect to average atomic distance. This film will be referred to hereinafter a diamond-like carbon film. Such a diamond-like carbon film may be formed by various methods such as ionic beam deposition, chemical vapor deposition, plasma-assisted chemical vapor deposition and the like wherein plasma-assisted chemical vapor deposition is preferred. In the present embodiment, the silicon substrate 10 covered by silica as the heat accumulation layer 16 is disposed in a vacuum chamber after deposition of the heater 11 and the electrodes 14 and 15. Then a source gas comprising a mixture of hydrocarbon such as methane, ethane, propane, butane, ethylene and the like is introduced into the chamber and a radio frequency electrical power having a frequency at 13.56 MHz is supplied across a pair of parallel electrodes. Thereby, a glow discharge is established and the source gas is decomposed into radicals and ions. When these products of the decomposition is contacted with the surface of the heater base, there is deposited a hard carbon film having the diamond-like structure, covering the heater 11 and the electrodes 14 and 15. Note that the carbon film thus deposited contains small amount of hydrogen. The following Table II shows the condition of deposition and Table III summarizes the property of the film thus obtained.

TABLE II

Condition of deposition

| | |
|---|---|
| pressure | $10^{-3}$–10 Torr |
| hydrocarbon/ | 100–0.5% |
| hydrocarbon + hydrogen | 100–0.5% |
| temperature | RT–950° C. |
| RF power | 0.1–50 watts/cm$^2$ |

RT: room temperature

TABLE III

Property of diamond-like carbon

| | |
|---|---|
| specific resistance | $10^6$–$10^{-13}$ Ωcm |
| thermal conductivity | 200–800 W.m$^{-1}$.K$^{-1}$ |
| dielectric constant | about 5 |
| Vickers hardness | 9500 kg/mm$^2$ |
| refractive index | 1.9–2.4 |
| defect density | $10^{17}$–$10^{19}$ cm$^{-3}$ |

Preferrably, the protective layer 12 is formed to have a thickness of 0.01–10 μm, more preferrably 0.05–5 μm, and most preferrably 0.05–3 μm to obtain a best result. By comparing the thermal conductivity with that of other materials listed in the following TABLE IV taken from Chronological Scientific Tables, ed. Tokyo Astronomical Observatory, Maruzen Co., Ltd, Tokyo, it is clear that the diamond-like carbon thus synthesized has a very large thermal conductivity and is ideal for the protective layer of heater of the bubble jet printer.

TABLE IV

| Thermal conductivity of various materials | | |
|---|---|---|
| material | temperature (°C.) | $K(W.m^{-1}.K^{-1})$ |
| acryl | RT | 0.17–0.25 |
| asphalt | RT | 1.1–1.5 |
| alumina | RT | 21 |
| | 800 | 7 |
| sulfur (rhombic) | 20 | 0.27 |
| (monoclinic) | 100 | 0.16–0.17 |
| (amorphous) | 0 | 0.2 |
| mica | 100–600 | 0.55–0.79 |
| paper | RT | 0.06 |
| glass (soda) | RT | 0.55–0.75 |
| (lead) | 15 | 0.6 |
| (Pyrex) | 30–75 | 1.1 |
| glass wool | RT | 0.04 |
| pumice (density 0.6) | 20 | 0.2 |
| silicon | 0 | 168 |
| germanium | 0 | 67 |
| diatomaceous earth | 25–650 | 0.07–0.1 |
| silk | 40 | 0.05 |
| ice | 0 | 2.2 |
| cork | RT | 0.04–0.05 |
| rubber (hard) | 0 | 0.2 |
| (soft) | RT | 0.1–0.2 |
| (sponge) | 25 | 0.04 |
| concrete | RT | 1 |
| porcelain | RT | 1.5 |
| plaster | 20 | 0.8 |
| quartz (parallel to axis) | 70 | 9.3 |
| (perpendicular to axis) | 70 | 5.4 |
| sand | 20 | 0.3 |
| quartz glass | 0 | 1.4 |
| | 100 | 1.9 |
| asbestos (cemented plate) | RT | 0.3 |
| (cloth) | RT | 0.1 |
| (cotton) | RT | 0.06 |
| gypsum | RT | 0.13 |
| selenium (amorphous) | 0 | 0.43 |
| refractory brick | 600 | 1.1 |
| | 1000 | 1.3 |
| carbon (graphite) | 0 | 80–230 |
| | 300 | 50–130 |
| | 700 | 35–70 |
| (amorphous) | 0 | 1.5 |
| | 300 | 2.2 |
| | 700 | 2.5 |
| soil (dry) | 20 | 0.14 |
| nylon | RT | 0.27 |
| ash | 20 | 0.03 |
| paraffin | RT | 0.24 |
| fiber | 50 | 0.2–0.3 |
| felt | RT | 0.04 |
| polyethylene | RT | 0.25–0.34 |
| polystyrene | RT | 0.08–0.12 |
| cardboard | RT | 0.2 |
| calcite(parallel to axis) | 0 | 5.39 |
| (perpendicular to axis) | 0 | 4.51 |
| fluorite | 0 | 10.3 |
| wood (dry) | 18–25 | 0.14–0.18 |
| cotton cloth | 40 | 0.08 |
| blanket | 30 | 0.04 |
| wool | RT | 0.04 |
| snow (density 0.11) | 0 | 0.11 |
| (density 0.45) | 0 | 0.57 |
| linoleum | 20 | 0.08 |
| brick (red) | RT | 0.5–0.6 |
| brick (porous) | 20 | 0.2 |
| cotton | RT | 0.03 |

RT: room temperature

Further, the lid cover 21 is provided on the base plate 22 thus constructed 52 such that the passage 25 registers with the electrodes 14 and 15 and the heater 11. When a drive current is supplied across the electrodes 14 and 15, the heater 11 is heated and the heat thus produced is transferred to the ink as already described.

The following TABLE V shows the performance of the printer head thus constructed in comparison with conventional printer head using silica for the protective layer. The measurement was conducted by using a heater having a size of 30 μm×30 μm×0.5 μm and the thickness of the protective layer was set to 0.8 μm for both samples. In the TABLE IV, "frequency response" represents a maximum frequency which the printer head can respond and "life time" represents the number of times the droplet is ejected until the printer head fails. The test for the life time was undertaken at a frequency of 3 kHz for both samples. As can be seen from this table, the printer head using the diamond-like carbon for the protective layer has a superior frequency response and has an extended lifetime.

TABLE IV

| | sample 1 | sample 2 |
|---|---|---|
| substrate | Si | Si |
| heat accumulation layer | $SiO_2$ | $SiO_2$ |
| heater | $HfB_2$ | $HfB_2$ |
| protective layer | $SiO_2$ | diamond-like carbon |
| Max response frequency | 3 kHz | 4 kHz |
| life time | $10^8$–$10^9$ | more than $10^9$ |

Using the printer head of the present embodiment, one can obtain a clear image responsive to application of a control current across the electrodes 14 and 15 in accordance with an image signal while supplying a fresh ink with such a pressure that no spontaneous ejection or spill of the ink occur.

Next, description will be given for the ink or recording liquid used in the printer of the present invention. The ink is adjusted its composition so as to satisfy various requirements such as thermal properties and other properties as well as chemical and physical stability similarly to the inks used in the conventional printer. Further, the ink for use in the printer of the present invention is required to satisfy requirements such excellent response, fidelity, ability of forming fiber, absence of solidification in the passage particularly near the orifice, capability of flowing through the passage at a speed corresponding to the recording speed, rapid fixation whenever the ink has reached a paper, sufficient recording density, long pot life, and the like.

In order to satisfy aforementioned requirements, the ink for use in the printer of the present invention uses a carrier liquid, a recording material suitably dispersed in the carrier liquid for forming the printed image on a paper, and additives to be added for achieving the various desirable properties. By changing the carrier liquid and the additives as well as by varying the composition, one can obtain ink of water soluble type, non-water soluble type, soluble type to the carrier liquid, conductive type, insulating type, and the like.

The carrier liquid is generally divided into water-soluble solvents and non-water soluble solvents. The water-soluble solvents used for the ink suitable for the printer of the present invention include: alkyl alcohols having 1–10 carbon atoms such as methyl alcohol, ethyl alcohol, n-propyl alcohol, isopropyl alcohol, n-butyl alcohol, sec-butyl alcohol, tert-butyl alcohol, isobutyl alcohol, pentyl alcohol, hexyl alcohol, heptyl alcohol, octyl alcohol, nonyl alcohol, decyl alcohol etc.; hydrocarbon solvents such as hexane, octane, cylcopentane, benzen, toluene, xylol etc.; halogenated hydrocarbon solvents such as carbon tetrachloride, trichloroethylene, tetrachloroethane, dichlorobenzen, etc; ether solvents such as ethylether, butylether, ethylene glycol diethylether, ethylene glycol monoethylether etc; ketone solvents such as acetone, methylethylketone, methylpropylketone, methylamylketone, cyclohexanone etc; ester solvents such as ethyl formate, methyl acetate, propyl acetate, phenyl acetate, ethylene glycol monoethylether acetate etc; alcohol solvents such as diacetone alcohol etc; and high-boiling hydrocarbon solvents.

These carrier liquids are suitably selected in consideration of the affinity to the recording material and other additives to be employed and to satisfy the aforementioned requirements. The carrier liquids may also be used as a mixture of two or more solvents or a mixture with water, if necessary and within a limit that a desirable recording medium is obtainable.

Among the carrier liquids mentioned above, water and water-alcohol mixtures are preferred in view of avoiding contamination to the environment as well as availability.

The recording material has to be selected in relation to the above-mentioned carrier liquid as well as to the additives such that sedimentation and coagulation in the passage or storage tank is avoided and further that clogging of the transportation pipe or the ink passage is avoided even after a prolonged standing. From this view point, use of recording material which is soluble to the carrier liquid is preferred, though materials difficult to be dissolved or not dissolving into the carrier liquid can be used similarly as long as they have sufficiently small particle size which facilitates dispersion into the liquid.

The recording material is selected depending on the type of paper and the condition of printing. Typical recording material may be dye and pigment. The dye is selected to satisfy the already described various requirements and include water-soluble dyes such as direct dyes, basic dyes, acid dyes, solubilized vat dyes, acid mordant dyes and mordant dyes, and water-insolublke dyes such as sulfide dyes, vat dyes, spirit dyes, oil dyes and disperse dyes; and other dyes such as stylene dyes, naphthol dyes, reactive dyes, chrome dyes, 1:2 type complex dyes, 1:1 type complex dyes, azoic dyes, cationic dyes, etc.

More specifically, preferred dyes are: Resolin Brilliant Blue PRL, Resolin Yellow PCG, Resolin Pink PRR, Resolin Green PB (available from Farbefabriken Bayer AG); Sumikaron Blue S-BG, Sumikaron Red E-EBL, Sumikaron Yellow E-4GL, Sumikaron Brilliant Blue S-BL (available from Sumitomo Chemical Co., Ltd.); Dianix Yellow HG-SE, Dianix Red BN-SE (available from Mitsubishi Chemical Industries, Ltd.); Kayalon Polyester Light Flavin 4GL, Kayalon Polyester Blue 3R-SF, Kayalon Polyester Yellow YL-SE, Kayaset Turquoise Blue 776, Kayaset Yellow 902, Kayaset Red 026, Procion Red H-2B, Procion Blue H-3R (available from Nippon Kayaku Co., Ltd.); Levafix Golden Yellow P-R, Levafix Brilliant Red P-B, Levafix Brilliant Orange P-GR (available from Farbefabriken Bayer AG); Sumifix Yellow GRS, Sumifix Red B, Sumifix Brilliant Red BS, Sumifix Brilliant Blue PB, Direct Black 40 (available from Sumitomo Chemical Co., Ltd.); Diamira Brown 3G, Diamira Yellow G, Diamira Blue 3R, Diamira Brilliant Blue B, Diamira Brilliant Red BB (available from Mitsubishi Chemical Industries); Remazol Red B, Remazol Blue 3R, Remazol Yellow GNL, Remazol Brilliant Green 6B (available from Farbwerke Hoechst AG); Cibacron Brilliant Yellow, Cibacron Brilliant Red 4GE (available from Ciba Geigy); Indigo Direct Deep Black E.Ex, Diamin Black BH, Congo Red, Sirius Black, Orange II, Amid Black 10B, Orange RO, Metanil Yellow, Victoria Scarlet, Nigrosine, Diamond Black PBB (available from I.G. Farbenindustrie AG); Diacid Blue 3G, Diacid Fast Green GW, Diacid Milling Navy Blue R, Indanthrene (available from Mitsubishi Chemical Industries, Ltd.); Zabon dye (available from BASF); Oleosol dyes (available from CIBA); Lanasyn dyes (Mitsubishi Chemical Industries, Ltd.); Diacryl Orange RL-E, Diacryl Brilliant Blue 2B-E, Diacryl Turquiose Blue BG-E (available from Mitsubishi Chemical Industries, Ltd.), and the like.

These dyes are suitably selected and used in a form of solution or suspension in the carrier liquid.

Various inorganic and organic pigments can also be used for the recording material. Such inorganic pigments include: cadmium sulfide, sulfur, selenium, zinc sulfide, cadmium sulfoselenide, chrome yellow, zinc chromate, molybdenum red, guignet's green, titanium dioxide, zinc oxide, hematite, green chromium oxide, read lead, cobalt oxide, barium titanate, titanium yellow, black iron oxide, iron blue, litharge, cadmium red, silver sulfide, lead sulfide, barium sulfide, ultramarine, calcium carbonate, magnesium carbonate, white lead, cobalt violet, cobalt blue, emerald green, carbon black, and others.

Organic pigments, on the other hand, are mostly classified as organic dyes and thus overlaps with those already cited. Preferred examples thereof include:

(a) Insoluble azo pigments (naphthols):
Brilliant Carmine BS, Lake Carmine FB, Brilliant Fast Scarlet, Lake Red 4R, Para red, Permanent Red R, Fast Red FGR, Lake Bordeaux 5B, Bar Million No. 1, Bar Million No. 2, Toluidine Maroon;

(b) Insoluble azo-pigments (anilides):
Diazo Yellow, Fast Yellow, G. Fast Yellow 100, Diazo Orange, Vulcan Orange, Ryrazolon Red;

(c) Soluble azo-pigments:
Lake Orange, Brilliant Carmine 3B, Brilliant Carmine 6B, Brilliant Scarlet G, Lake Red C, Lake Red D, Lake Red R, Watching Red, Lake Bordeaux 10B, Bon Maroon L, Bon Maroon M;

(d) Phthalocyanine pigments:
Phthalocyanine Blue, Fast Sky Blue, Phthalocyanine Green;

(e) Lake pigments:
Yellow Lake, Eosine Lake, Rose Lake, Violet Lake, Blue Lake, Green Lake, Sepia Lake;

(f) Mordant dyes:
Alizarine Lake, Madder Carmine, (g) Vat dyes:
Indanthrene, Fast Blue Lake (GGS);

(h) Basic dyes:
Rhodamine Lake, Malachite Green Lake;

(i) Acidic dye Lakes:
Fast Sky Blue, Quinoline Yellow Lake, quinacridone pigments, dioxazine pigments.

The ratio of the recording material to be employed in the present invention to the carrier liquid is determined in consideration of eventual clogging of the ink passage, drying of the ink in the passage, blot of ink when printed, rate of drying and the like and is generally set to 1–50 parts by weight, preferably 3–30 parts by weight, and most preferably 5–10 parts by weight with respect to 100 part carrier liquid.

When the ink is the dispersion type in which the recording material is dispersed in the carrier liquid, the particle size of the recording material has to be determined in consideration with the type of the recording material, condition of printing, inner diameter of the ink passage, diameter of the orifice, and the type of the paper. When the particle size is excessive, sedimentation of the particle tends to occur and various undesirable effect such as inhomogeneity of the ink, clogging of the ink passage, inhomogeneous thickness of the printed image and the like may occur.

In consideration of these problems and effects, the particle size of the recording material used in the dispersion type ink is generally set to 0.01–30 μm, preferably to 0.01–20 μm, most preferrably to 0.01–8 μm. Further, the particle size distribution of the dispersed recording medium is desired to be as narrow as possible. Generally the particle size falls in a range of D±3 μm where D stands for a mean particle diameter, wherein a range of D±1.5 μm is preferred.

As for the additives, various agents such as viscosity adjusting agent, surface tension adjusting agent, pH adjusting agent, specific resistance adjusting agent, as well as humectant and infrared absorbent are used.

The first two agents are added in order to achieve the already described various properties as well as to facilitate the ink to flow through the passage with a sufficient speed corresponding to the printing speed and to avoid uncontrolled spill of the ink from the orifice, and to prevent blurr or spread when applied to the paper.

Any known materials conventionally used for adjusting viscosity and surface tension may be used for the viscosity adjusting agent and the surface tension adjusting agent. Some examples for the viscosity adjusting agent include: polyvinyl alcohol, hydroxypropyl cellulose, carboxymethyl cellulose, hydroxyethyl cellulose, methyl cellulose, water-soluble acryl resin, polyvinylpyrrolidone, arabic rubber starch, and others.

The surface tension adjusting agent includes anionic, cationic and nonionic surfactants, wherein the anionic surfactants includes polyethylene glycol ether sulfate and ester salts, the cationic surfactants includes poly-2-vinylpyridine derivatives and poly-4-vinylpyridine derivatives, and the nonionic surfactants includes polyoxyethylenealkyl ether, polyoxyethylenealkylphenyl ether, polyoxyethylenealkyl ester, polyoxyethylenesorbitanmonoalkyl ester, polyoxyethylenealkylamine, and the like.

In addition to these surfactants, amin acids such as diethanolamine, propanolamine, morpholinamin and the like, basic materials such as ammonium hydrooxide, sodium hydrooxide and the like, or substituted pyrrolidone such as N-methyl-2-pyrrolidone may also be used.

More than two of these surface tension adjusting agents may be mixed within a ratio such that a desirable surface tension is achieved together with the desirable properties already described and the unwanted effect to other constituents is suppressed.

The amount of the surface tension adjusting agent should be determined depending on the composition of the formulated ink as well as on the desired printing characteristic and is usually set to 0.0001–0.1 parts by weight with respective to the carrier liquid wherein a range of 0.001–0.01 parts by weight is preferred.

The pH adjusting agent is used in order to achieve chemical stability of the formulated ink such as stability against change of property of ink or sedimentation and coagulation of the recording material for a prolonged time period. The amount of the additive is also set such that the desired property of ink is retained.

Any known pH adjusting additives may be used for this purpose as long as they do not provide deteriorating effect to the ink. Such additives include lower alkanolamine, hydrooxide of monovalent metals such as alkali metals, ammonium hydrooxide, and the like.

These pH adjusting agents are added within a limit such that the obtained ink does not deviate from the aforementioned property.

As for the lubricant agents, any known lubricants may be used unless they brings deviation of the property of the ink. Particularly, thermally stable lubricants are preferred. Such lubricants include: polyalkylene glycols such as polyethylene gylcol, polypropylene glycol; alkylene glycols having 2–6 carbon atoms in the alkylene group such as butylene glycol, hexylene glycol; low alkyl ethers such as ethylene glycol methyl ether, diethylene glycol methyl ether, diethylene glycol ethyl ether; low alcohol oxytriglycols such as methoxyitri glycol, ethoxytri glycol; N-vinyl-2-pyrrolidone oligomer, and the like.

These additives are added to the ink within a limit to provide the ink the desirable properties and usually added by 0.1–10 percent by weight, preferrably 0.1–8 percent by weight, and most preferably 0.2–7 percent by weight with respect to the overall weight of the ink. Further, the two or more lubricants may be mixed unless there is no deteriorative effect on the property of the ink.

Further, the ink used in the printer of the present invention may be added with other resin polymers such as alkid resin, acryl resin, acrylamide resin, polyvinyl alcohol, polyvinyl pyrrolidone and the like so as to facilitate film formation or to achieve strength of the formed film.

As already noted, the ink used in the printer of the present invention is formulated such that the ink has optimum specific heat, thermal expansion coefficient, thermal conductivity, viscosity, surface tension, pH and the like. In case the ink droplet is charged at the time of ejection, the ink is further adjusted its specific resistivity.

These properties are closely related to the stability in forming fiber, response and fidelity to the action of thermal energy, thickness of the printed image, chemical stability, flowability in the ink passage and the like and have to be carefully adjusted at the time of formulation of the ink.

The following TABLE VI lists some desirable properties or the ink for use in the printer of the present invention. However, it should be understood that not all of these properties have to be satisfied numerically but some may be deviated depending on the need. However, the values for the specific heat, thermal expansion coefficient, thermal conductivity, viscosity and surface tension should be observed in order to obtain a good printing. Of course, a better printing can be achieved when more items of TABLE VI are satisfied.

TABLE IV

| | desirable properties of ink | | |
|---|---|---|---|
| | normal | preferred | most preferred |
| specific heat (J/gK) | 0.1–4.0 | 0.5–2.5 | 0.7–2.0 |
| thermal expansion coefficient ($\times 10^3$ deg$^{-1}$) | 0.1–1.8 | 0.5–1.5 | — |
| viscosity | 0.3–30 | 1–20 | 1—10 |

TABLE IV-continued

| | desirable properties of ink | | |
|---|---|---|---|
| | normal | preferred | most preferred |
| (centi poise) | | | |
| thermal conductivity ($\times 10^3$ W/cm. deg) | 0.1–50 | 1–10 | — |
| surface tension (dyn/cm) | 10–60 | 15–50 | — |
| pH | — | 6–12 | — |

As is clear from the foregoing explanations, the present invention achieves high speed printing by improving response of the printer head. Further, because of the efficient heat dissipation, a large recording density of more than 16 lines/mm can be achieved. In the prototype head, it is confirmed that even a recording density of 48 lines/mm can be possible. Further, the structure is simple and easily manufactured.

In combination with the use of diamond-like carbon protective film having a significantly high thermal conductivity for the heater, the printer heat of the present invention has an further improved response together with long lifetime which results from its high corrosion resistance and stability.

Further, the present invention is not limited to these embodiments but various variations and modifications may be made without departing from the scope of the invention.

What is claimed is:

1. A printer head of a bubble jet printer apparatus for ejecting a droplet of ink from an orifice by a dilational force of a bubble formed in the ink as a result of heating, comprising:

a base plate comprising a substrate and a thermally insulating layer provided on the substrate so as to cover at least a part thereof in correspondence to where the ink is heated, said thermally insulating layer having a thickness which does not prevent quick dissipation of heat to the substrate;

an ink chamber provided on the base plate for accepting the ink;

means for supplying the ink to the ink chamber;

an ink passage provided on said base plate in communication with the ink chamber at a first end thereof and to the orifice at a second end thereof for passing the ink from the ink chamber to the orifice; and heating means provided on the thermally insulating layer in correspondence to said ink passage for heating the ink therein to form said bubble, said heating means comprising:

a first electrode strip provided on the thermally insulating layer so as to extend to the ink chamber along the ink passage, an electrical insulator layer provided so as to cover the first electrode strip except for a first end thereof away from the ink chamber and a second end thereof close to the ink chamber, said electrical insulator layer having a front end facing the orifice such that the first end of the first electrode strip is exposed at the front end of the electrical insulator layer, a resistance strip provided on the electrical insulator layer with a first end thereof in contact with said first end of the first electrode strip and extending along the electrical insulator layer toward the ink chamber, covering the front end of the electrical insulator layer, such that the resistance strip acts as a heat source generating heat in response to an electric current flowing therethrough between the first end and the rear end thereof, a second electrode strip provided on the electrical insulator layer in contact with a second end of the resistance strip and extending to the ink chamber along the electrical insulator layer, a heater protective film provided on the resistance strip for protecting the resistance strip from corrosion, and an electrode protective film provided on the second electrode strip for protecting the second electrode strip from corrosion;

wherein said substrate has a thermal conductivity which is at least twenty times greater than that of the thermally insulating layer.

2. A printer head as claimed in claim 1 in which the thermal conductivity of said substrate is at least seventy times larger than that of the thermally insulating layer.

3. A printer head as claimed in claim 1 in which the thermal conductivity of said substrate is at least seventy-seven times greater than that of the thermally insulating layer.

4. A printer head as claimed in claim 1 in which said substrate comprises silicon and said thermally insulating layer comprises silica.

5. A printer head as claimed in claim 1 in which said substrate comprises alumina and said thermally insulating layer comprises silica.

6. A printer head as claimed in claim 1 in which said heater protective film comprises a carbon film having structure in which atomic arrangement is similar to that of diamond.

7. A printer head as claimed in claim 6 in which said heater protective film has a thickness in a range from 0.01 μm to 10 μm.

8. A printer head as claimed in claim 7 in which the thickness of the heater protective film is between 0.05 μm and 5 μm.

9. An ink jet printer head as claimed in claim 8 in which the thickness of the heater protective film is between from 0.05 μm and 3 μm.

10. A bubble jet printer head comprising:

a base plate having a top surface and a front end and a rear end;

a cover plate coupled to the base plate and facing said top surface of the base plate to define between the two plates an ink chamber at the rear end of the base plate and a number of ink passages running from the ink chamber toward the front end of the base plate and terminating in respective ink ejection orifices;

said base plate comprising a substrate having a top surface and a thermally insulating layer covering at least selected portions of said top surface of the substrate;

heating means provided on the thermally insulating layer and aligned with said ink passage for heating the ink therein to form bubbles, said heating means comprising for each of said ink passages:

a first electrode strip provided on the thermally insulating layer and extending from the ink chamber end of the ink passage toward the orifice of the ink passage;

an electrical insulator layer covering the first electrode strip except for a front end thereof and a rear end thereof to thereby leave uncovered by said first electrical insulator layer a front end of the first electrode strip facing the orifice and a rear end of said first electrode strip facing the ink chamber;

a resistance strip provided on the electrical insulator layer to serve as a heat source and having a front end which is in contact with and covers said front end of the first electrode strip and extending rearwardly over and along the electrical insulator layer toward the ink chamber and having a rear end facing the ink chamber, said resistance strip acting as a heat source generating heat in response to an electric current flowing therethrough between the front end and the rear end thereof;

a second electrode strip provided on the electrical insulator layer in contact with the rear end of the resistance strip and extending rearwardly over and along the electrical insulator layer toward the ink chamber;

a heater protective film provided on the resistance strip to protect said resistance strip; and an electrode protective film provided on the second electrode strip to protect said second electrode strip;

wherein the thermal conductivities and thicknesses of said substrate and said thermally insulating layer are selected to cause rapid initial build up of heat at the resistance strip when the resistance strip is first energized by the passage of current therethrough and thereafter to cause rapid dissipation of heat from the resistance strip through the thermally insulating layer into the substrate.

11. A bubble jet printer head as in claim 10 in which the thickness of said thermally insulating layer is about 1 micron or less and the thickness of the substrate is many microns and the thermal conductivity of the substrate is at least 20 times that of the thermally insulating layer.

* * * * *